US008978275B2

(12) United States Patent
James

(10) Patent No.: US 8,978,275 B2
(45) Date of Patent: Mar. 17, 2015

(54) FOOTWEAR WITH PLURALITY OF INTERLOCKING MIDSOLE AND OUTSOLE ELEMENTS

(75) Inventor: Dervin A. James, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 528 days.

(21) Appl. No.: 13/494,120

(22) Filed: Jun. 12, 2012

(65) Prior Publication Data

US 2012/0278999 A1 Nov. 8, 2012

Related U.S. Application Data

(63) Continuation-in-part of application No. 12/365,583, filed on Feb. 4, 2009, now Pat. No. 8,215,037.

(51) Int. Cl.

| | |
|---|---|
| ***A43B 13/14*** | (2006.01) |
| ***A43B 13/16*** | (2006.01) |
| ***A43B 13/00*** | (2006.01) |
| ***A43B 13/12*** | (2006.01) |
| ***A43B 1/00*** | (2006.01) |
| ***A43B 13/18*** | (2006.01) |

(52) U.S. Cl.

CPC ..... *A43B 13/16* (2013.01); *A43B 13/12* (2013.01); *A43B 1/0027* (2013.01); *A43B 1/0072* (2013.01); *A43B 13/188* (2013.01)

USPC ..... 36/103; 36/15; 36/31

(58) Field of Classification Search

CPC ..... A43B 13/16; A43B 13/188; A43B 13/18; A43B 13/187; A43B 13/28; A43B 13/12; A43B 13/122; A43B 13/125

USPC ..... 36/103, 25 R, 35 R, 15, 31, 20, 102

See application file for complete search history.

(56) References Cited

U.S. PATENT DOCUMENTS

| | | | |
|---|---|---|---|
| 190,113 | A | 5/1877 | Arnold |
| 500,385 | A | 6/1893 | Hall |
| 1,148,584 | A | 8/1915 | Gerrish |
| 1,575,813 | A | 3/1926 | Burke |
| 1,741,419 | A | 12/1927 | Jones |
| 1,907,136 | A | 8/1931 | Weitsen |
| 2,046,732 | A | 1/1936 | Fein |
| 2,088,902 | A | 7/1936 | Fein |
| 2,237,892 | A | 4/1941 | Jacob |

(Continued)

OTHER PUBLICATIONS

Office action dated Oct. 21, 2011, U.S. Appl. No. 12/365,583, filed Feb. 4, 2009.

*Primary Examiner* — Jila M Mohandesi

(74) *Attorney, Agent, or Firm* — Honigman Miller Schwartz and Cohn LLP; Matthew H. Szalach

(57) ABSTRACT

A method of manufacturing an article of footwear includes providing an outsole and a midsole. The outsole and the midsole are secured together such that a bottom surface of a first midsole element overlaps and directly secures to an upper surface of a first outsole element to define a first element assembly, such that a bottom surface of a second midsole element overlaps and directly secures to an upper surface of a second outsole element to define a second element assembly, and such that an outsole groove and a midsole groove are substantially aligned and in communication with each other in the thickness direction of the outsole and the thickness direction of the midsole. Moreover, the method includes interlocking the first and second element assemblies with each other.

20 Claims, 3 Drawing Sheets

(56) References Cited

U.S. PATENT DOCUMENTS

| | | | | |
|---|---|---|---|---|
| 2,928,193 | A | 2/1958 | Kristan | |
| 3,517,928 | A | 6/1970 | Shanahan | |
| 3,594,929 | A | 7/1971 | Stohr | |
| 3,952,429 | A | 4/1976 | Thomas | |
| 4,128,950 | A | 12/1978 | Bowerman et al. | |
| 4,237,626 | A | 12/1980 | Brown | |
| 4,364,188 | A | 12/1982 | Turner et al. | |
| 4,408,402 | A | 10/1983 | Looney | |
| 4,557,060 | A | 12/1985 | Kawashima | |
| 4,608,768 | A | 9/1986 | Cavanagh | |
| 4,624,061 | A | 11/1986 | Wezel et al. | |
| 4,930,231 | A | 6/1990 | Liu | |
| 5,729,912 | A | 3/1998 | Gutkowski et al. | |
| 5,813,146 | A | 9/1998 | Gutkowski et al. | |
| 6,092,305 | A | 7/2000 | Troy et al. | |
| 6,453,578 | B1 * | 9/2002 | Yung et al. | 36/43 |
| 6,519,876 | B1 | 2/2003 | Geer et al. | |
| 6,701,643 | B2 | 3/2004 | Geer et al. | |
| 7,059,067 | B2 | 6/2006 | Geer et al. | |
| 7,210,250 | B2 | 5/2007 | Gallegos | |
| 7,334,350 | B2 | 2/2008 | Ellis, III | |
| 7,334,352 | B2 | 2/2008 | Lacey | |
| 7,434,335 | B2 * | 10/2008 | Feldstein | 36/8.3 |
| D581,643 | S * | 12/2008 | Bauerfeind et al. | D2/961 |
| D627,550 | S * | 11/2010 | Zhang | D2/961 |
| 8,230,619 | B2 * | 7/2012 | Salvatelli et al. | 36/88 |
| 8,402,678 | B1 * | 3/2013 | Kopelman | 36/140 |
| 2006/0213081 | A1 | 9/2006 | Geer et al. | |
| 2007/0271817 | A1 | 11/2007 | Ellis, III | |
| 2008/0000108 | A1 | 1/2008 | Ellis, III | |
| 2008/0005931 | A1 | 1/2008 | Ellis, III | |

* cited by examiner

FOOTWEAR WITH PLURALITY OF INTERLOCKING MIDSOLE AND OUTSOLE ELEMENTS

CROSS-REFERENCE TO RELATED APPLICATION

This application is a continuation-in-part of U.S. patent application Ser. No. 12/365,583, filed on Feb. 4, 2009, now U.S. Pat. No. 8,215,037. The entire disclosure of the above application is incorporated herein by reference.

FIELD

The present disclosure relates to footwear and, more particularly, relates to an article of footwear with a plurality of interlocking midsole and outsole elements.

BACKGROUND

Articles of footwear usually include an upper, a midsole, and an outsole. The upper can include sections of thin material, straps, or the like for securing the footwear to the wearer's foot. The outsole is typically a unitary piece of relatively high-friction material that provides traction for the footwear. Also, the midsole can be a unitary piece of foam or other similar material disposed between the upper and the outsole for providing cushioned support for the wearer.

SUMMARY

A method of manufacturing an article of footwear is disclosed. The method includes providing an outsole and a midsole. The outsole including an outsole groove that extends generally in a thickness direction through the outsole to separate the outsole into first and second outsole elements. The first and second outsole elements each include a respective upper surface. The midsole includes a midsole groove that extends generally in a thickness direction through the midsole to separate the midsole into first and second midsole elements. The first and second midsole elements each include a respective bottom surface. The outsole and the midsole are secured together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, and such that the outsole groove and the midsole groove are substantially aligned and in communication with each other in the thickness direction of the outsole and the thickness direction of the midsole. Moreover, the method includes interlocking the first and second element assemblies with each other.

Additionally, a method of customizing an article of footwear is also disclosed. The method includes selecting an outsole including an outsole groove that extends generally in a thickness direction through the outsole to separate the outsole into first and second outsole elements. The first and second outsole elements each include a respective upper surface. The method also includes selecting a midsole including a midsole groove that extends generally in a thickness direction through the midsole to separate the midsole into first and second midsole elements. The first and second midsole elements each include a respective bottom surface. The midsole and the outsole are secured together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, such that the outsole groove and the midsole groove are substantially aligned and in communication with each other in the thickness direction of the outsole and the thickness direction of the midsole, and such that the first and second element assemblies interlock with each other. The first midsole element differs from the second midsole element by a different material, a different color, a different durometer, and/or a different resistance to resilient deformation.

Still further, a method of customizing an article of footwear is disclosed that includes selecting an outsole including an outsole groove that extends generally in a thickness direction through the outsole to separate the outsole into first and second outsole elements. The first and second outsole elements each include a respective upper surface. The method also includes selecting a midsole including a midsole groove that extends generally in a thickness direction through the midsole to separate the midsole into first and second midsole elements. The first and second midsole elements each include a respective bottom surface. The midsole and the outsole are secured together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, such that the outsole groove and the midsole groove are substantially aligned and in communication with each other in the thickness direction of the outsole and the thickness direction of the midsole, and such that the first and second element assemblies interlock with each other. The first outsole element differs from the second outsole element by a different coefficient of friction, a different material, a different thickness, and/or a different color.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
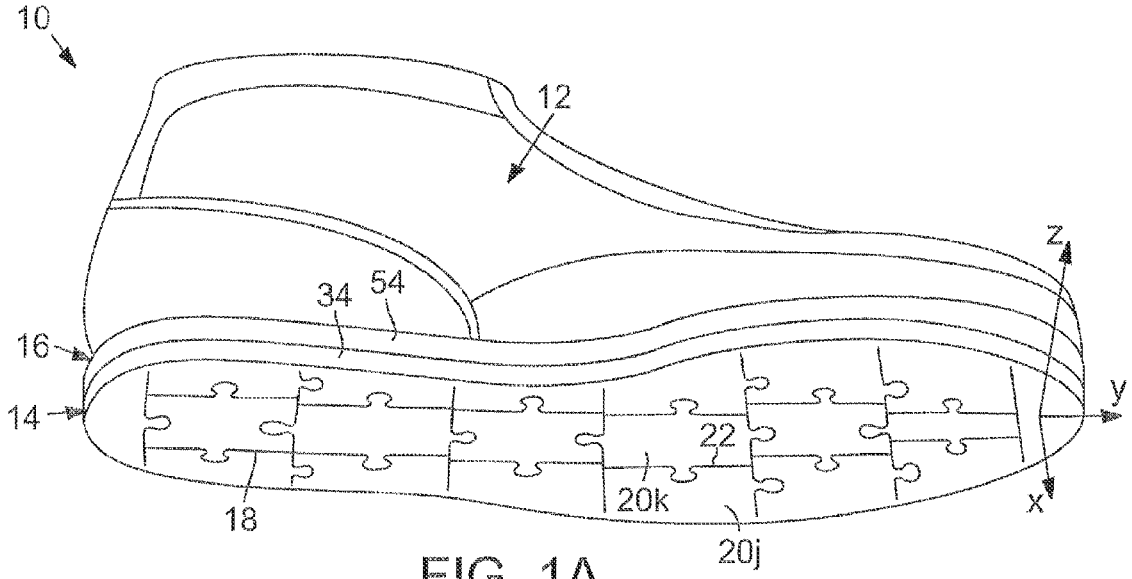
FIG. 1A is an isometric view of an exemplary embodiment of an article of footwear according to various teachings of the present disclosure.
Figure 2:
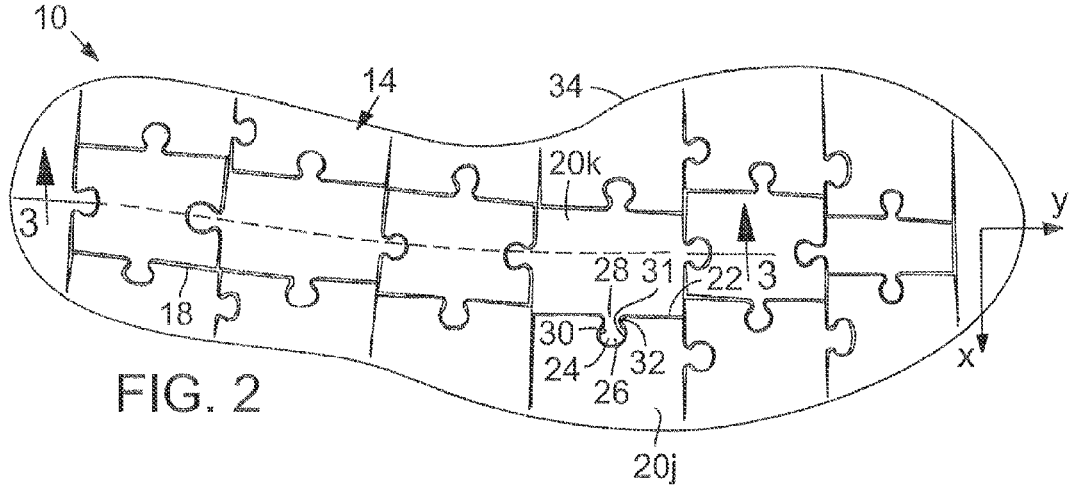
FIG. 2 is a bottom plan view of the article of footwear of FIG. 1A.

Referring initially to FIGS. 1A and 2, an exemplary embodiment of an article of footwear 10 is illustrated according to various teachings of the present disclosure. For purposes of discussion, the footwear 10 will be discussed using a reference coordinate system X, Y, Z (FIG. 1).

Generally, the article of footwear 10 includes an upper 12, an outsole 14, and a midsole 16. As will be discussed, the midsole 16 is operably secured to both the upper 12 and the outsole 14, and the midsole 16 is disposed between the upper 12 and the outsole 14. The midsole 16 and the outsole 14 generally extend in transverse directions (i.e., within the X-Y plane) (FIG. 1A), and the midsole 16 and the outsole 14 each have a thickness defined along a thickness direction (i.e., along the Z-axis).

In some embodiments, the upper 12 includes various thin sections of material that partially overlap each other and that are operably secured to each other, for example, by stitching, adhesives, and the like. The upper 12 defines a cavity in which the wearer's foot is received. The upper 12 can also include a fastening structure, such as laces, buckles, and/or other features for tightly securing the upper 12 to the foot of the wearer. It will also be appreciated that the upper 12 can include various decorative features. In addition, the upper 12 can have any suitable shape and/or features that adapt the article of footwear 10 for its intended use.

Figure 1B:
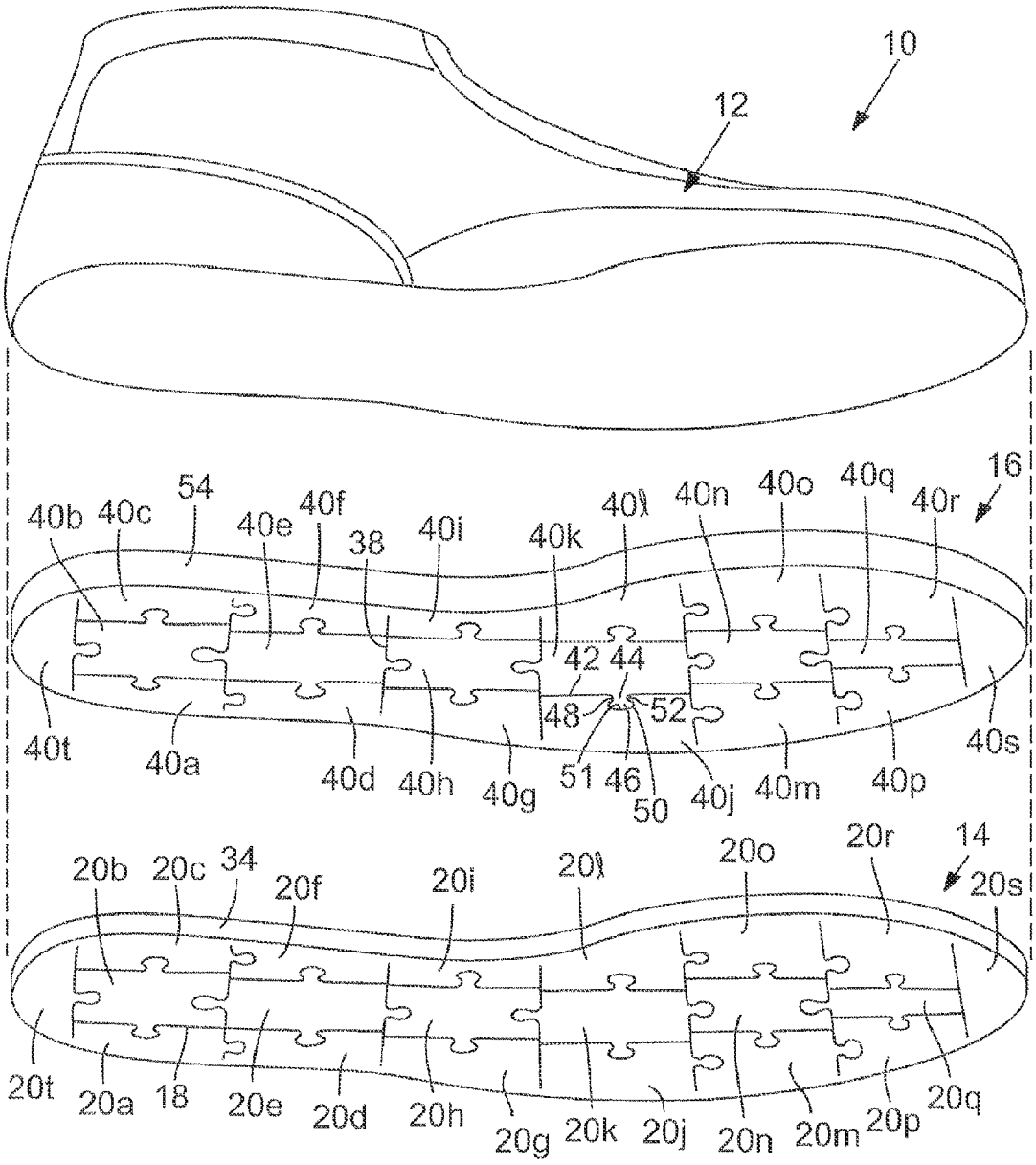
FIG. 1B is an exploded view of the article of footwear of FIG. 1A.

As shown in FIGS. 1A, 1B, and 2, the outsole 14 can include a layer of material that extends in the transverse directions (i.e., within the X-Y plane). The outsole 14 can also have any suitable curvature along the transverse directions. Additionally, the outsole 14 can have any suitable thickness (i.e., along the Z-axis), and the thickness of the outsole 14 can vary in any suitable fashion. Moreover, the outsole 14 can include various grooves, projections or other features for increasing traction of the footwear 10.

Figure 3:
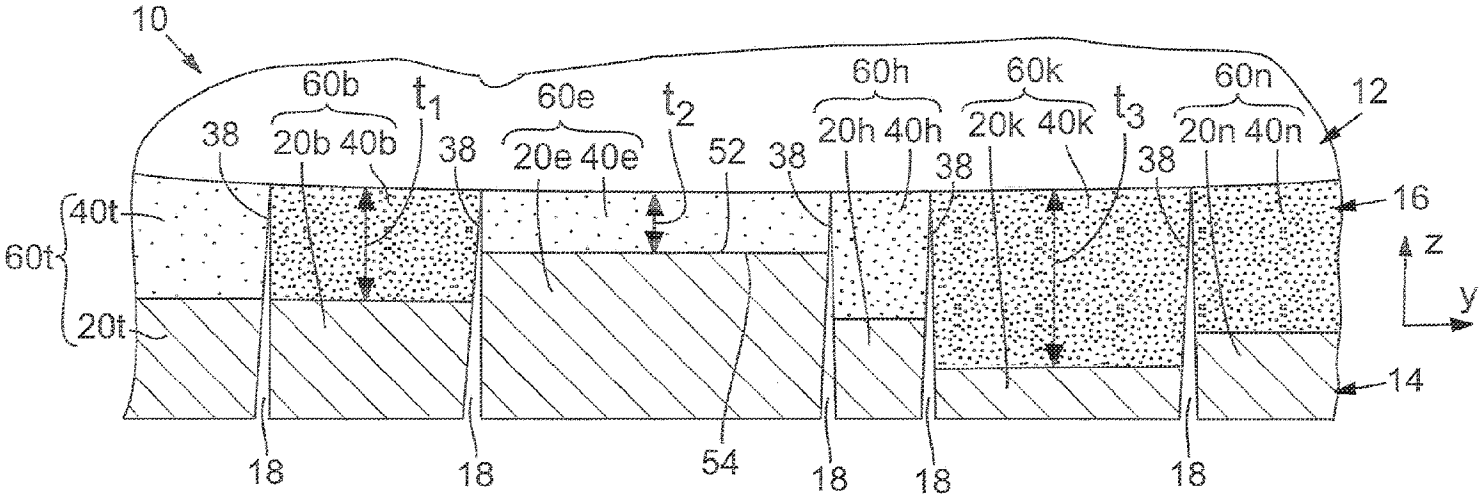
FIG. 3 is a sectional view of the article of footwear of FIG. 1A.

In addition, the outsole 14 includes a plurality of outsole grooves 18. As shown in FIG. 3, the outsole grooves 18 extend entirely through the thickness of the outsole 14 (i.e., along the Z-axis); however, the outsole grooves 18 can extend only partially through the thickness of the outsole 14 in some embodiments. Also, the outsole grooves 18 extend in the transverse directions (i.e., within the X-Y plane) (FIGS. 1A and 2). As such, the outsole grooves 18 separate the outsole 14 into a plurality of separate outsole elements 20*a*-20*t* (FIG. 1B). The outsole elements 20*a*-20*t* can have any suitable shape and size. In the embodiment shown, the outsole elements 20*a*-20*t* each have a plurality of generally planar sides 22 that extend in the thickness direction. The planar sides 22 of adjacent outsole elements 20*a*-20*t* face each other. In some embodiments, the outsole grooves 18 are wide enough in the transverse directions to space the outsole elements 20*a*-20*t* apart slightly (e.g., 1-2 millimeters). However, the grooves 18 can have a relatively small width, allowing the outsole elements 20*a*-20*t* to abut each other in some embodiments. As will be discussed, the outsole grooves 18 increase flexibility of the outsole 14 and can make the outsole 14 more versatile.

Furthermore, in some embodiments, the outsole grooves 18 are shaped such that the outsole elements 20*a*-20*t* interlock with each other. In the embodiment shown, the outsole elements 20*a*-20*t* are shaped in a fashion similar to interlocking jigsaw puzzle pieces (FIG. 2). For instance, the outsole element 20*k* includes a projection 24 that projects from the respective planar side 22 (FIG. 2). Moreover, an adjacent outsole element (e.g., element 20*j*) includes a recess 30 that recesses into the respective planar side 22. The recess 30 receives the projection 24 to interlock elements 20*k* and 20*j*. As shown, the other outsole elements 20*a*-20*t* can also include respective interlocking pairs of projections 24 and recesses 30.

The projections 24 and recesses 30 can have any suitable shape. For instance, in the embodiments shown, the projection 24 includes an enlarged head 26 and a neck portion 28, which is narrower than the enlarged head 26. The neck portion 28 is disposed between the head 26 and the respective planar side 22 of the outsole element 20*a*-20*t*. Furthermore, the recess 30 includes an enlarged portion 31 and a narrow portion 32. The enlarged portion 31 of the recess 30 receives the enlarged head 26 of the projection 24 such that the narrow portion 32 of the recess 30 limits movement of the enlarged head 26 out of the enlarged portion 31 of the recess 30. Accordingly, as will be discussed, the outsole elements 20*a*-20*t* can shift slightly relative to each other for added flexibility of the footwear 10. However, the outsole elements 20*a*-20*t* interlock with each other to maintain sufficient union of the outsole 14.

Furthermore, in some embodiments, the outsole 14 includes an outer periphery 34 that is entirely continuous (FIGS. 1A, 1B, 2). More specifically, as shown in FIG. 1B, the outsole elements 20*a*, 20*d*, 20*g*, 20*j*, 20*m*, 20*p*, 20*s*, 20*r*, 20*o*, 20*l*, 20*i*, 20*f*, 20*c*, and 20*t* ("the peripheral outsole elements") cooperate to define the outer periphery 34 of the outsole 14. The remaining outsole elements 20*b*, 20*e*, 20*h*, 20*k*, 20*n*, and 20*q* ("the interior outsole elements") are spaced apart from the outer periphery 34 of the outsole 14.

The peripheral outsole elements 20*a*, 20*d*, 20*g*, 20*j*, 20*m*, 20*p*, 20*s*, 20*r*, 20*o*, 20*l*, 20*i*, 20*f*, 20*c*, and 20*t* are each integrally coupled to adjacent ones of the peripheral outsole elements 20*a*, 20*d*, 20*g*, 20*j*, 20*m*, 20*p*, 20*s*, 20*r*, 20*o*, 20*l*, 20*i*, 20*f*, 20*c*, and 20*t* such that the outer periphery 34 is entirely continuous. For instance, the outsole groove 18 separating outsole elements 20*f* and 20*i* (FIG. 1B) does not extend in the transverse direction to the outer periphery 34, and elements 20*f* and 20*i* are integrally coupled to each other adjacent the outer periphery 34. In some embodiments, the outsole groove 18 separating outsole elements 20*f* and 20*i* (FIG. 1B) tapers and terminates immediately adjacent the outer periphery 34 to maintain the continuous outer periphery 34 of the outsole 14. Accordingly, because the outer periphery 34 is entirely continuous, the outsole 14 holds together to limit excessive relative movement of the outsole elements 20*a*-20*t*. In addition, the entirely continuous outer periphery 34 can aid in handling of the outsole 14, for instance, during manufacture of the footwear 10.

It will be appreciated that the outsole 14 can be made out of any suitable material. For instance, the outsole 14 can be made out of a high-friction polymeric material, such as rubber. Also, in some embodiments, the outsole 14 can be made out of a transparent material so that the midsole 16 is visible through the outsole 14. Also, it will be appreciated that the outsole elements 20*a*-20*t* can vary in material, thickness, function, aesthetics, and the like. Accordingly, the outsole elements 20*a*-20*t* can be selected according to the respective transverse location of the outsole element 20*a*-20*t* on the footwear 10, making the outsole 14 more versatile and adaptable as will be discussed in greater detail below.

Additionally, as shown in FIGS. 1A, 1B, and 3, the midsole 16 can include a layer of material that extends in the transverse directions (i.e., within the X-Y plane). The midsole 16 can also have any suitable curvature along the transverse directions. Furthermore, the midsole 16 can have any suitable thickness (i.e., along the Z-axis), and the thickness of the midsole 16 can vary in any suitable fashion.

In addition, the midsole 16 includes a plurality of midsole grooves 38 (FIG. 1B and 3). As shown in FIG. 3, the midsole grooves 38 extend entirely through the thickness of the midsole 16 (i.e., along the Z-axis); however, the midsole grooves 38 can extend only partially through the thickness of the midsole 16 in some embodiments. Also, the midsole grooves 38 extend in the transverse directions (i.e., within the X-Y plane) (FIG. 1B). As such, the midsole grooves 38 separate the midsole 16 into a plurality of separate midsole elements 40*a*-40*t* (FIG. 1B). The midsole elements 40*a*-40*t* can have any suitable shape and size. In the embodiments shown, the midsole elements 40*a*-40*t* each have a plurality of generally planar sides 42 that extend in the thickness direction. The planar sides 42 of adjacent midsole elements 40*a*-40*t* face each other. In some embodiments, the midsole grooves 38 are wide enough in the transverse directions to space the midsole elements 40*a*-40*t* apart slightly (e.g., 1-2 millimeters). However, the grooves 38 can have a relatively small width, allowing the midsole elements 40*a*-40*t* to abut each other in some embodiments. As will be discussed, the midsole grooves 38 increase flexibility of the midsole 16 and can make the midsole 16 more versatile.

Furthermore, in some embodiments, the midsole grooves 38 are shaped such that the midsole elements 40*a*-40*t* interlock with each other. In the embodiment shown, the midsole elements 40*a*-40*t* are shaped in a fashion similar to interlocking jigsaw puzzle pieces (FIG. 1B). For instance, the midsole element 40*k* includes a projection 44 that projects from the respective planar side 42. Moreover, an adjacent midsole element (e.g., element 40*j*) includes a recess 50 that recesses into the respective planar side 42. The recess 50 receives the projection 44 to interlock elements 40*k* and 40*j*. As shown, the other midsole elements 40*a*-40*t* can also include respective interlocking pairs of projections 44 and recesses 50.

The projections 44 and recesses 50 can have any suitable shape. For instance, in the embodiment shown in FIG. 1B, the projection 44 includes an enlarged head 46 and a neck portion 48, which is narrower than the enlarged head 46. The neck portion 48 is disposed between the head 46 and the respective planar side 42 of the respective midsole element 40*a*-40*t*. Furthermore, the recess 50 includes an enlarged portion 51 and a narrow portion 52. The enlarged portion 51 of the recess 50 receives the enlarged head 46 of the projection 44 such that the narrow portion 52 of the recess 50 limits movement of the enlarged head 46 out of the enlarged portion 51 of the recess 50. Accordingly, as will be discussed, the midsole elements 40*a*-40*t* can shift slightly relative to each other for added flexibility of the footwear 10. However, the midsole elements 40*a*-40*t* interlock with each other to maintain sufficient union of the midsole 16.

Furthermore, in some embodiments, the midsole 16 includes an outer periphery 54 that is entirely continuous (FIGS. 1A and 1B). More specifically, as shown in FIG. 1B, the midsole elements 40*a*, 40*d*, 40*g*, 40*j*, 40*m*, 40*p*, 40*s*, 40*r*, 40*o*, 40*l*, 40*i*, 40*f*, 40*c*, and 40*t* ("the peripheral midsole elements") cooperate to define the outer periphery 54 of the midsole 16. The remaining midsole elements 40*b*, 40*e*, 40*h*, 40*k*, 40*n*, and 40*q* ("the interior midsole elements") are spaced apart from the outer periphery 54 of the midsole 16.

The peripheral midsole elements 40*a*, 40*d*, 40*g*, 40*j*, 40*m*, 40*p*, 40*s*, 40*r*, 40*o*, 40*l*, 40*i*, 40*f*, 40*c*, and 40*t* are each integrally coupled to adjacent ones of the peripheral midsole elements 40*a*, 40*d*, 40*g*, 40*j*, 40*m*, 40*p*, 40*s*, 40*r*, 40*o*, 40*l*, 40*i*, 40*f*, 40*c*, and 40*t* such that the outer periphery 54 is entirely continuous. For instance, the midsole groove 38 separating midsole elements 40*f* and 40*i* (FIG. 1B) does not extend in the transverse direction to the outer periphery 54, and elements 40*f* and 40*i* are integrally coupled to each other adjacent the outer periphery 54. In some embodiments, the midsole groove 38 separating midsole elements 40*f* and 40*i* (FIG. 1B) tapers and terminates immediately adjacent the outer periphery 54 to maintain the continuous outer periphery 54 of the midsole 16. Accordingly, because the outer periphery 54 is entirely continuous, the midsole 16 holds together to limit excessive relative movement of the midsole elements 40*a*-40*t*. In addition, the entirely continuous outer periphery 54 can aid in handling of the midsole 16, for instance, during manufacture of the footwear 10.

It will be appreciated that the midsole 16 can be made out of any suitable material. For instance, the midsole 16 can be made out of any suitable foam material, such as Ethylene Vinyl Acetate (EVA) foam and/or Thermoplastic Polyurethane (TPU). The midsole 16 can also include a material with air pockets or fluid-filled bladders included therein, such as materials disclosed in U.S. Pat. No. 7,386,946, issued Jun. 17, 2008 to Goodwin, U.S. Pat. No. 7,070,845, issued Jul. 4, 2006 to Thomas et al., and/or U.S. Patent Publication No. 2006/0230636, published Oct. 19, 2006 to Kokstis et al., each of which is incorporated herein by reference in its entirety. Also, it will be appreciated that the individual midsole elements 40*a*-40*t* can vary in material, thickness, function, aesthetics, and the like. Accordingly, the midsole elements 40*a*-40*t* can be selected according to the respective transverse location of the midsole element 40*a*-40*t* on the footwear 10, making the midsole 16 more versatile and adaptable as will be discussed in greater detail below.

As shown in FIGS. 1B and 3, the outsole grooves 18 can be substantially aligned with the midsole grooves 38 so that the midsole and outsole grooves 38, 18 substantially overlap in plan view (FIG. 2). Accordingly, the midsole and outsole grooves 38, 18 are in communication with each other in the thickness direction (i.e., along the Z-axis) as shown in FIG. 3. It will be appreciated, however, that the outsole grooves 18 can be misaligned with the midsole grooves 38 in some embodiments. Furthermore, it will be appreciated that the outsole 14 can be a continuous sheet of material while the midsole 16 includes the individual midsole elements 40*a*-40*t*. Likewise, it will be appreciated that the midsole 16 can be a continuous sheet of material while the outsole 14 can include the individual outsole elements 20*a*-20*t*.

Furthermore, in the embodiment shown in FIG. 3, individual ones of the outsole elements 20*a*-20*t* are operably secured to corresponding ones of the midsole elements 40*a*-40*t*. Accordingly, each outsole element 20*a*-20*t* pairs with a respective midsole element 40*a*-40*t* to define an element assembly 60*a*-60*t* (FIG. 3). In some embodiments shown in FIG. 3, an upper surface 52 of the outsole element 20*e* is fixed to a bottom surface 54 of the midsole element 40*e* such that the elements 20*e*, 40*e* collectively define an element assembly 60*e*. It will be appreciated that the outsole elements 20*a*-20*t* can be operably secured to the respective midsole elements 40*a*-40*t* in any suitable fashion. In some embodiments, the outsole elements 20*a*-20*t* are fixed to corresponding ones of the midsole elements 40*a*-40*t*, such as by adhesive or other bonding. Also, in some embodiments, the outsole elements 20*a*-20*t* are removably coupled to corresponding ones of the midsole elements 40*a*-40*t*.

Because the outsole elements 20*a*-20*t* and midsole elements 40*a*-40*t* are separate from other ones of the outsole elements 20*a*-20*t* and midsole elements 40*a*-40*t*, the footwear 10 can be adapted, adjusted, and customized in a variety of ways. For instance, different outsole elements 20*a*-20*t* varying in thickness, coefficient of friction, material, color, etc. can be interlocked and integrated in the footwear 10. Likewise, different midsole elements 40*a*-40*t* varying in thickness, resistance to resilient deformation, material, color, etc. can be interlocked and integrated in the footwear 10.

More specifically, as shown in FIG. 3, the thickness of the individual midsole elements 40*a*-40*t* can vary. More specifically, in the embodiments shown, the midsole element 40*b* has a thickness of $t_1$, the midsole element 40*e* has a thickness $t_2$, and the midsole element 40*k* has a thickness $t_3$. As shown, the thickness $t_1$ of element 40*b* is greater than the thickness $t_2$ of element 40*e*, but the thickness $t_1$ of element 40*b* is less than the thickness $t_3$ of element 40*k*. Furthermore, the resistance to resilient deformation of the midsole elements 40*t*, 40*b*, 40*e*, 40*h*, 40*k*, and 40*n* can vary as shown in FIG. 3. For instance, element 40*t* can have a lower density, durometer, etc. than elements 40*b*, 40*k*, and 40*n* (as represented by cross hatching in FIG. 3), and element 40*h* can have a lower density, durometer, etc. than element 40*t*. As such, the elements 40*b*, 40*k*, and 40*n* can provide higher resistance to resilient deformation than that of elements 40*t* and 40*h*, and element 40*h* can provide higher resistance to resilient deformation than element 40*t*.

Figure 4:
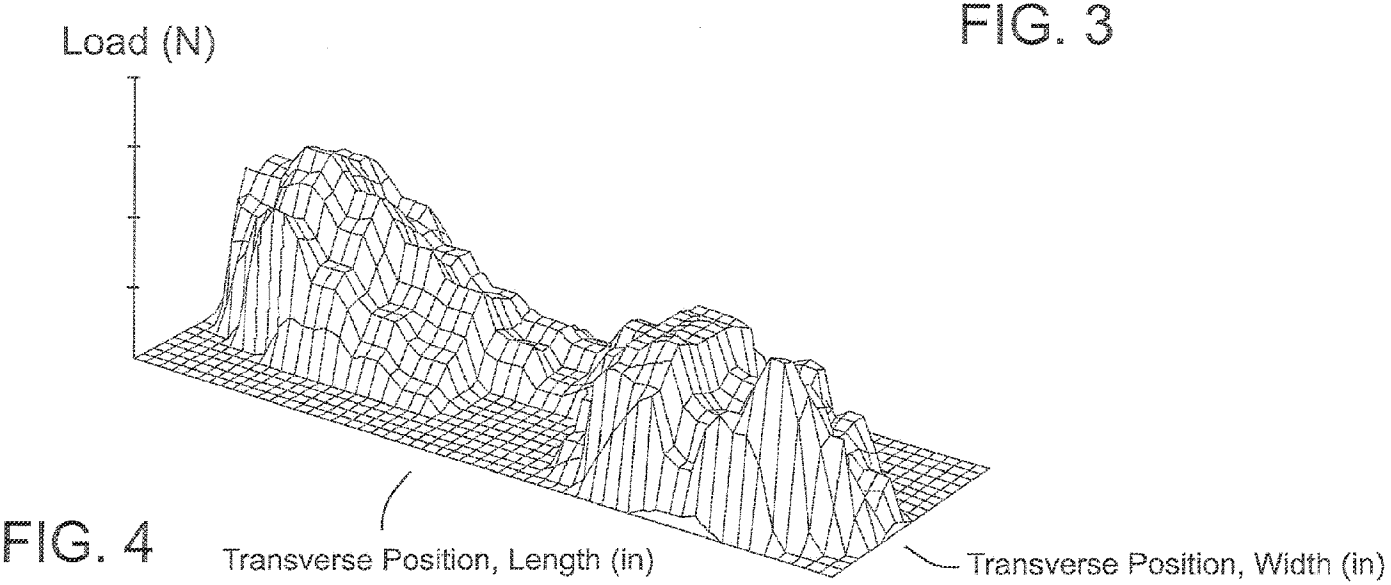
FIG. 4 is an exemplary embodiment of a pressure map illustrating a pressure distribution for the article of footwear of FIG. 1A.

FIG. 4 illustrates a pressure "map" of the footwear 10 to represent the location of the highest and lowest pressure on the midsole 16 during use of the footwear 10. For instance, loading can be highest near the center of the heel of the wearer. Thus, midsole element 40*b* can have a preselected thickness, durometer, material, or any other characteristic to handle the increased pressure loading. Other midsole elements 40*a*, 40*c*-40*t* can be similarly selected. For instance, loads near the arch of the foot are relatively low, and thus, midsole element 40*e* can have a preselected thickness, durometer, material, or any other characteristic to handle the decreased pressure loading. Accordingly, the midsole 16 is very versatile.

The outsole elements 20*a*-20*t* can be preselected in a similar fashion. For instance, the individual outsole elements 20*a*-20*t* can be selected to provide higher friction in some areas of the outsole 14 as compared to other areas. Also, in the embodiment shown in FIG. 3, the thickness of each outsole element 20*a*-20*t* is such that the outsole elements 20*a*-20*t* are flush with each other on a side opposite from the midsole elements 40*a*-40*t*; however, it will be appreciated that the outsole elements 20*a*-20*t* can have any suitable thickness.

Manufacture of the footwear 10 can be accomplished in any suitable fashion. For instance, in some embodiments, the outsole elements 20*a*-20*t* are individually selected and assembled, and the individual midsole elements 40*a*-40*t* are individually selected and assembled in a similar fashion. Then, the outsole 14 is bonded to the midsole 16 (e.g., in a molding process), and the midsole 16 is bonded to the upper 12. Alternatively, the outsole 14 can be removably secured to the midsole 16 and/or the midsole 16 can be removably secured to the upper 12.

In another embodiment, the peripheral midsole elements 40*a*, 40*d*, 40*g*, 40*j*, 40*m*, 40*p*, 40*s*, 40*r*, 40*o*, 40*l*, 40*i*, 40*f*, 40*c*, and 40*t* are integrally coupled, leaving an opening for the remaining midsole elements 40*b*, 40*e*, 40*h*, 40*k*, 40*n*, and 40*q*. The midsole elements 40*b*, 40*e*, 40*h*, 40*k*, 40*n*, and 40*q* are selected and arranged between the peripheral midsole elements 40*a*, 40*d*, 40*g*, 40*j*, 40*m*, 40*p*, 40*s*, 40*r*, 40*o*, 40*l*, 40*i*, 40*f*, 40*c*, and 40*t*. The outsole elements 20*a*-20*t* of the outsole 14 are assembled in a similar fashion. Then, the midsole 16 is operably secured to the outsole 14, and the upper 12 is operably secured.

In another embodiment, the outsole 14 and the midsole 16 are initially monolithic layers of material. The outsole 14 and midsole 16 are operably secured together, and then the outsole grooves 18 and the midsole grooves 38 are subsequently formed therein. For instance, a laser cutting process can be used to form the grooves 18, 38.

It will be appreciated that the grooves 18, 38 increase the flexibility of the outsole 14 and the midsole 16, and yet the continuous outer peripheries 34, 54 of the outsole 14 and the midsole 16 serve to hold the outsole 14 and the midsole 16 together for added durability and uniform flexion of the footwear 10. Moreover, because the element assemblies 60*a*-60*t* interlock, the element assemblies 60*a*-60*t* can distribute loads to each other to improve performance of the footwear 10.

Moreover, the footwear 10 can facilitate recycling. For instance, because of the outsole and midsole grooves 18, 38, the element assemblies 60*a*-60*t* can be easily separated from each other for recycling purposes.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method of manufacturing an article of footwear comprising:

providing an outsole and a midsole, the outsole including an outsole groove that extends generally in a thickness direction through the outsole to separate the outsole into first and second outsole elements, the first and second outsole elements each including a respective upper surface, the midsole including a midsole groove that extends generally in a thickness direction through the midsole to separate the midsole into first and second midsole elements, the first and second midsole elements each including a respective bottom surface, the outsole and the midsole secured together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, and such that the outsole groove and the midsole groove are substantially aligned and in communication with each other in the thickness direction of the outsole and the thickness direction of the midsole; and interlocking the first and second element assemblies with each other.

2. The method of claim 1, wherein providing the midsole includes providing the first midsole element having a higher resistance to resilient deformation than the second midsole element.

3. The method of claim 1, wherein providing the midsole includes providing the first midsole element that is made of a different material than the second midsole element.

4. The method of claim 1, wherein interlocking the first and second element assemblies includes receiving a projection of the first element assembly in a recess of the second element assembly.

5. The method of claim 4, wherein the projection includes an enlarged head and a neck, and the recess includes an enlarged portion and a narrow portion, and wherein interlocking the first and second element assemblies includes the enlarged portion receiving the enlarged head and the narrow portion limiting movement of the enlarged head out of the enlarged portion of the recess.

6. The method of claim 1, wherein the midsole groove extends entirely through the midsole in the thickness direction.

7. The method of claim 1, wherein the outsole groove extends entirely through the outsole in the thickness direction.

8. The method of claim 1, wherein the midsole includes an entirely continuous outer periphery.

9. The method of claim 1, wherein the outsole includes an entirely continuous outer periphery.

10. The method of claim 1, further comprising securing the midsole and the outsole together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, and such that the outsole groove and the midsole groove are substantially aligned and in communication with each other in the thickness direction of the outsole and the thickness direction of the midsole.

11. A method of customizing an article of footwear comprising:

selecting an outsole including an outsole groove that extends generally in a thickness direction through the outsole to separate the outsole into first and second outsole elements, the first and second outsole elements each including a respective upper surface; and selecting a midsole including a midsole groove that extends generally in a thickness direction through the midsole to separate the midsole into first and second midsole elements, the first and second midsole elements each including a respective bottom surface, the midsole and the outsole secured together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, such that the outsole groove and the midsole groove are substantially aligned and in communication with each other in the thickness direction of the outsole and the thickness direction of the midsole, and such that the first and second element assemblies interlock with each other, the first midsole element differing from the second midsole element by at least one of a different material, a different color, a different durometer, and a different resistance to resilient deformation.

12. The method of claim 11, wherein selecting the midsole includes selecting the at least one of the different material, the different color, the different durometer, and the different resistance to resilient deformation of the first midsole element based on a respective location of the first midsole element and the second midsole element within the midsole.

13. The method of claim 11, wherein the midsole groove extends entirely through the midsole in the thickness direction.

14. The method of claim 11, wherein the midsole includes an entirely continuous outer periphery.

15. The method of claim 11, further comprising securing the midsole and the outsole together and interlocking the first and second element assemblies together.

16. A method of customizing an article of footwear comprising:

selecting an outsole including an outsole groove that extends generally in a thickness direction through the outsole to separate the outsole into first and second outsole elements, the first and second outsole elements each including a respective upper surface; and selecting a midsole including a midsole groove that extends generally in a thickness direction through the midsole to separate the midsole into first and second midsole elements, the first and second midsole elements each including a respective bottom surface, the midsole and the outsole secured together such that the bottom surface of the first midsole element overlaps and directly secures to the upper surface of the first outsole element to define a first element assembly, such that the bottom surface of the second midsole element overlaps and directly secures to the upper surface of the second outsole element to define a second element assembly, such that the outsole groove and the midsole groove are substantially aligned and in communication with each other in the thickness direction of the outsole and the thickness direction of the midsole, and such that the first and second element assemblies interlock with each other, the first outsole element differing from the second outsole element by at least one of a different coefficient of friction, a different material, a different thickness, and a different color.

17. The method of claim 16, wherein selecting the outsole includes selecting the at least one of the different coefficient of friction, the different material, the different thickness, and the different color based on a respective location of the first outsole element and the second outsole element within the outsole.

18. The method of claim 16, wherein the outsole groove extends entirely through the outsole in the thickness direction.

19. The method of claim 16, wherein the outsole includes an entirely continuous outer periphery.

20. The method of claim 16, further comprising securing the midsole and the outsole together and interlocking the first and second element assemblies together.

* * * * *